United States Patent [19]

Lamb

[11] Patent Number: 4,581,881

[45] **Date of Patent: * Apr. 15, 1986**

[54] TEXTILE YARN SPINNING MACHINE WITH IMPROVED SUPPLY STRAND INTERRUPTION MEANS

[75] Inventor: Joseph T. Lamb, Concord, Mass.

[73] Assignee: Parks-Cramer Company, Fitchburg, Mass.

[ * ] Notice: The portion of the term of this patent subsequent to Mar. 26, 2002 has been disclaimed.

[21] Appl. No.: 671,170

[22] Filed: Nov. 13, 1984

Related U.S. Application Data

[63] Continuation-in-part of Ser. No. 587,396, Mar. 8, 1984, Pat. No. 4,506,498.

[51] Int. Cl.[4] ..... D01H 13/18

[52] U.S. Cl. ..... 57/87; 57/80; 57/86

[58] Field of Search ..... 57/78, 80, 81, 83–87, 57/264, 265

[56] References Cited

U.S. PATENT DOCUMENTS

| | | | |
|---|---|---|---|
| 3,523,413 | 8/1970 | Ford et al. | 57/265 |
| 3,659,409 | 5/1972 | Saunders | 57/265 |
| 3,726,072 | 4/1973 | Ford et al. | 57/87 X |
| 3,832,839 | 9/1974 | McClure | 57/83 X |
| 3,841,076 | 10/1974 | Ford et al. | 57/87 X |
| 4,000,603 | 1/1977 | Lee, Jr. | 57/87 |
| 4,112,665 | 9/1978 | Werst | 57/81 |
| 4,263,776 | 4/1981 | Lane | 57/87 |
| 4,326,371 | 4/1982 | Soar | 57/87 |
| 4,506,498 | 3/1985 | Lamb | 57/87 |

*Primary Examiner*—John Petrakes

*Attorney, Agent, or Firm*—Bell, Setlzer, Park & Gibson

[57] ABSTRACT

Apparatus for use in combination with a traveling unit including sensor and remote actuator means to interrupt supply strand feeding to drafting systems of a textile spinning machine. A collar means is rotatably mounted on an elongate strand guide and one side thereof serves as a strand engaging surface. An abutment member mounted on the strand guide serves as the other of the strand engaging surfaces. Means are provided for moving the strand engaging surfaces longitudinally along the elongate strand guide and into a proximate relation with one another upon the sensing of a broken yarn so as to pinch the supply strand and thereby interrupt feed of the supply strand to the drafting system.

6 Claims, 9 Drawing Figures

TEXTILE YARN SPINNING MACHINE WITH IMPROVED SUPPLY STRAND INTERRUPTION MEANS

CROSS-REFERENCE TO RELATED APPLICATION

This application is a continuation-in-part of U.S. patent application Ser. No. 587,396 filed on Mar. 8, 1984 now U.S. Pat. No. 4,506,498, issued 3/26/85.

FIELD AND BACKGROUND OF THE INVENTION

This invention relates generally to the textile industry, and more specifically, to the machinery used in the production of textile yarns. Textile spinning machines have long been used in the production of textile yarns, and various improvements have been added to the basic unit to obtain increases in efficiency. Included among these important developments are travelling units which simultaneously clean the machines, monitor yarn production, detect broken yarns and automatically accomplish interruption of the supply strand when a broken yarn is detected. Examples of devices of this type are disclosed in commonly owned U.S. Pat. Nos. 3,523,413; 3,659,409; 3,726,072; 3,841,076; 4,112,665 and 4,263,776.

Various devices have been used in these prior systems to effect interruption of supply strand feeding to the drafting systems of textile yarn spinning machines. Any reader interested in disclosures of suitable supply strand interruption devices is referred, by way of example only, to a number of commonly owned prior patents: U.S. Pat. No. 3,832,839 to McClure, U.S. Pat. No. 3,841,076 to Ford et al, U.S. Pat. No. 4,000,603 to Lee and U.S. Pat. No. 4,326,371 to Soar.

Those active in this art will be cognizant of the fact that a great variety of spinning machines are in use throughout this worldwide industry. It has heretofore been the practice to mount the strand interrupting apparatus to the "roll stand" portion of the drafting unit, but because of the tremendous variety of drafting unit arrangements on the various textile spinning machines, it has been necessary to custom design and manufacture a special mounting arrangement for the strand interrupting apparatus for each different drafting unit configuration.

In my copending application U.S. Ser. No. 587,396 a strand interruption apparatus is provided which is suitable for more universal application to the many and varied geometries of spinning machines available and in use. This is accomplished by mounting the strand interrupting apparatus between the supply package and the drafting system upon a supporting structure which is attached to the spinning machine itself, rather than to the individual roll stands. Several embodiments of the strand interrupting apparatus are disclosed. In general, these embodiments each comprise an elongate strand guide positioned between the supply strand packages and the drafting units and which extends longitudinally past a plurality of successive drafting units. A rotatably mounted collar is carried by the elongate strand guide, and includes a movable strand engaging surface which is adapted to cooperate with a corresponding fixed strand engaging surface associated with the elongated strand guide. The collar is normally oriented in a strand feeding position with the strand engaging surface of the collar positioned in a spaced apart relation from the cooperating strand engaging surface of the strand guide so that the strand is permitted to pass freely between the two strand engaging surfaces, but upon actuation the collar means is moved to a strand interrupting position in which the cooperating strand engaging surfaces are positioned in proximate relation to each other for interrupting feeding of the supply strand passing therebetween.

The present invention provides an improved strand interruption apparatus of the type described in my aforementioned copending application. The improvement in accordance with the present invention relates to a more easily workable strand interruption apparatus. A modified elongate strand guide is provided extending past a plurality of drafting stations. The strand interrupting apparatus further comprises a collar mounted for rotation about and longitudinal travel along the elongate strand guide. One end of the collar defines a strand engaging surface extending generally perpendicular to the axis of the strand guide while the opposite end of the collar forms a cam surface. An abutment member is also carried by the elongate strand guide and includes a strand engaging surface positioned opposite the strand engaging surface of the collar means. In addition, a sleeve-like member is carried by the elongate strand guide and is positioned opposite the cam surface end of the collar means. This sleeve-like member includes a cam surface that cooperates with the cam surface of the collar means.

Upon the sensing of a broken strand, an actuator means causes the collar means to rotate, and the cooperating cam surfaces, in turn, cause the collar means to move along the longitudinal axis of the elongate strand guide. The longitudinal movement of the collar means along the longitudinal axis of the elongate strand guide brings the strand engaging surfaces of the collar means and the abutment member into a proximate relationship with one another to effect interruption of the supply strand passing therebetween.

BRIEF DESCRIPTION OF THE DRAWINGS

Some of the features and advantages of the invention having briefly been stated, others will appear from the detailed description which follows, when taken in connection with the accompanying drawings, in which.

DETAILED DESCRIPTION OF THE ILLUSTRATED EMBODIMENT

Figure 1:
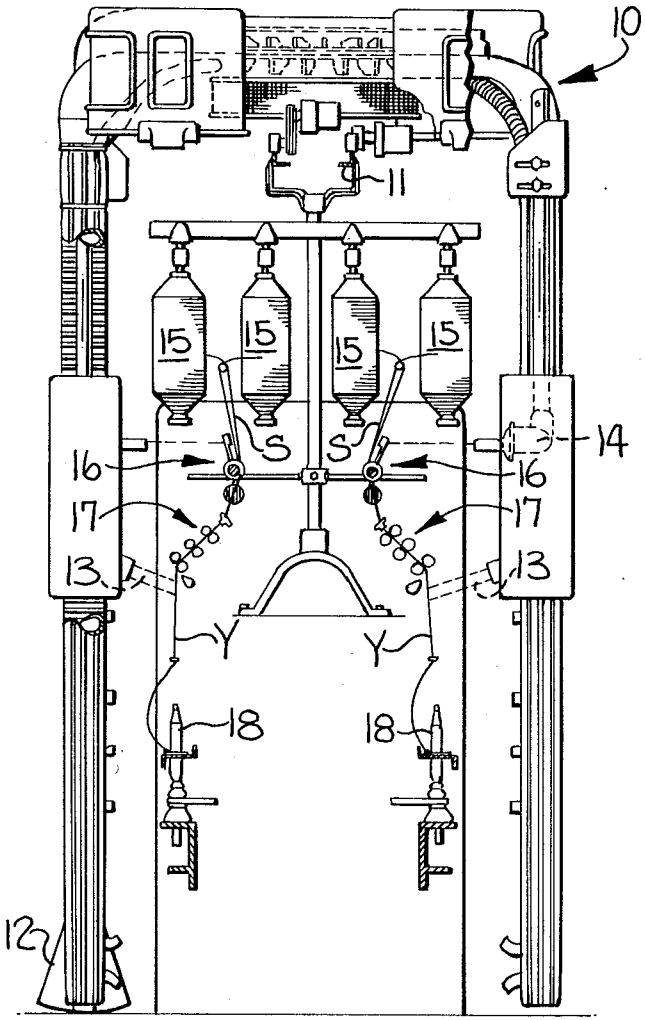
FIG. 1 is an end elevation view, partially in section and partially broken away, of a textile yarn spinning machine embodying a strand interruption apparatus in accordance with this invention.

Referring more specifically to the drawings, and particularly to FIG. 1, a portion of a textile spinning machine is there illustrated. As is known to persons familiar with the art, a spinning machine has as its primary purpose, the production of attenuated strands of textile fibers, i.e. yarns. To this end, the spinning machine includes a series of spinning stations. At each spinning station, a supply strand S is directed from a supply package 15 through the strand interrupting apparatus 16. The strand is then directed to the drafting system 17. The strand, upon emergence from the drafting zone has been attenuated into a yarn Y. Twist is then imparted to the yarn Y and it is taken up on a bobbin 18.

Frames of the type contemplated by the invention are equipped with a traveling unit, generally indicated at 10 which moves along a track 11 extending longitudinally of the spinning frame. This unit serves as a "tender", sensing the occurrence of broken yarns and interrupting the corresponding supply strands at such locations, all while simultaneously cleaning the machine and vacuuming lint fibers.

As shown, the typical spinning frame may be conceptualized as mirror image sections when divided along the longitudinal axis. In the embodiment illustrated, the traveling unit 10 is equipped with vacuum units 12, strand detectors 13, and strand interruption actuators 14 which operate on each side of the spinning frame. Further details of the structure and operation of the strand detectors 13 and strand interruption actuators 14 are disclosed in commonly owned U.S. Pat. No. 4,112,665 to Werst and interested readers may refer thereto for a more detailed disclosure of the apparatus.

As previously mentioned, the typical spinning machine consists of many individual drafting stations, of which all operate in an essentially identical manner. In order to facilitate a clear understanding of the invention and its embodiment, the operation of only one of these drafting stations and its cooperating interrupting apparatus will be discussed in detail. The reader will note however, that each drafting unit is equipped with a strand interrupting apparatus which is the subject matter of the instant application.

Figure 2:
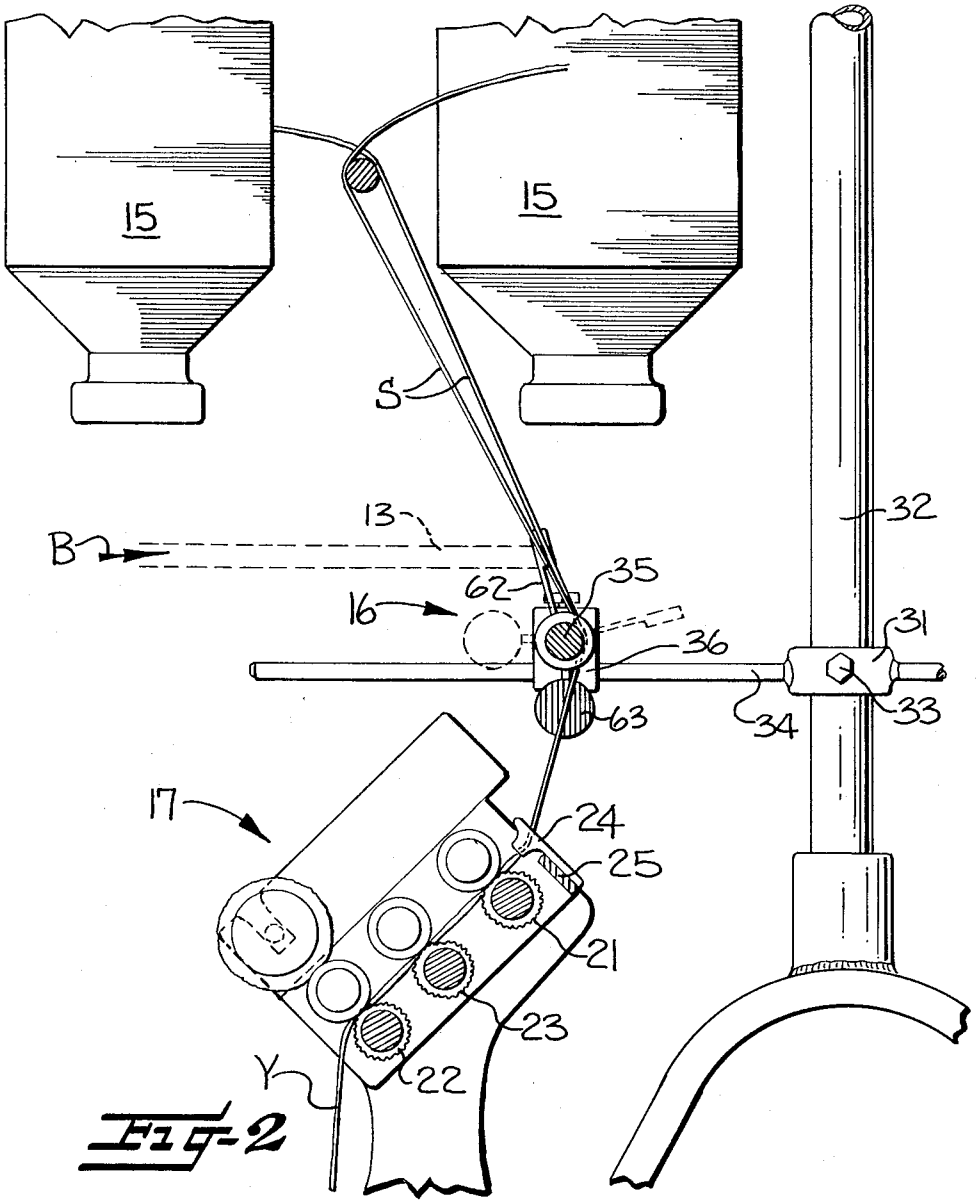
FIG. 2 is an enlarged fragmentary end elevation view of a spinning machine showing the strand interrupting apparatus located between the supply strand package and the drafting system.

The embodiment illustrated in FIG. 2 depicts the supply strand S passing through the strand interrupting apparatus 16 and then onto the drafting system, generally indicated at 17. More specifically, the drafting system 17 comprises three cooperating sets of rolls, including a set of rear rolls as generally indicated at 21, front or delivery rolls generally indicated at 22, and intermediate rolls 23. As is generally known to persons familiar with textile yarn spinning machines of the type illustrated, the series of rolls 21, 22, 23 define a series of aligned nips through which the supply strand S passes for attenuation. Adjacent the rear rolls 21 is disposed a trumpet 24 which is mounted on traverse bar 25. The trumpet 24 receives the supply strand S and directs the supply strand into the drafting system.

When the strand detector 13 (FIG. 1) receives a broken supply strand indication, the strand interruption apparatus 16 is actuated by appropriate means, usually a burst of air. The operation of the strand interruption apparatus appears later in this specification in appropriate detail.

Figure 3:
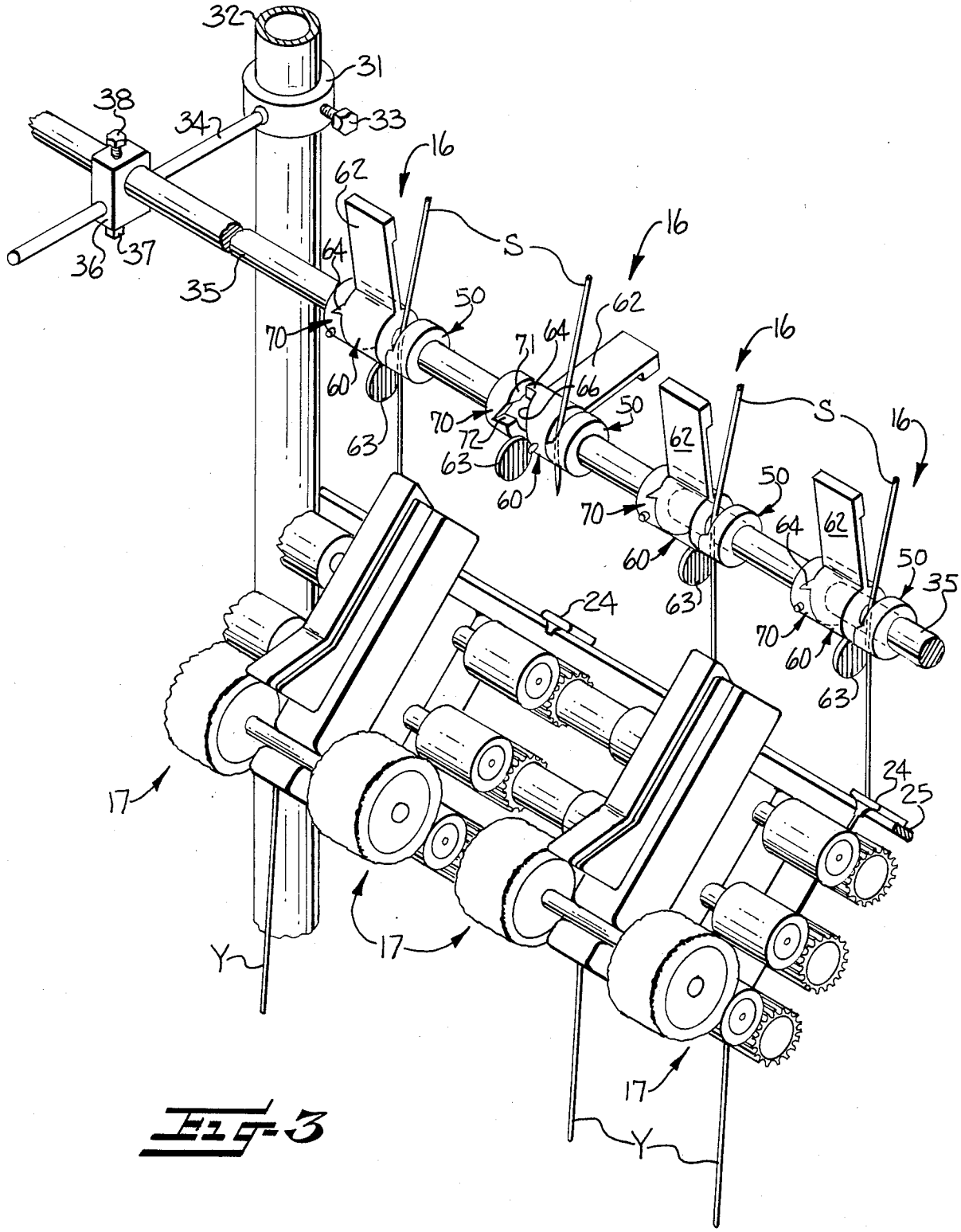
FIG. 3 is an enlarged perspective view of the portion of a textile spinning machine embodying this invention.

FIG. 3 is illustrative of the means by which the strand interruption apparatus may be easily fitted to any spinning frame currently in use or likely to be marketed in the future. In the past, strand interruption devices have been mounted directly on the drafting system. However, as is well known to persons familiar with the art, there are in use today a wide variety of spinning machines, each with its own peculiar creel arrangement, drafting system configuration, gauge spacing, etc. These differences among machines have necessitated the design and custom manufacture of a strand interruption mounting arrangement to match the pecularities of each type of spinning machine.

The design contemplated by this invention is based on the concept of separating the mounting of the strand interruption apparatus from the drafting system, and hence, eliminating the necessity for customizing the apparatus to fit the particular spinning machine involved.

The strand interruption apparatus includes an elongate strand guide which takes the form of an elongate bar 35. As illustrated, it extends longitudinally of the machine past a plurality of successive drafting units. The strand guide 35 is suspended a short distance above the rear of drafting system 17 for engaging and guiding the supply strand S in its course of travel from the supply package 15 to trumpet 24 of the drafting unit.

The adjustment means as shown in FIG. 3, is an integral part of this invention, as fitting the strand interruption apparatus to any spinning frame is easily accomplished. A clamp 31 surrounds the spinning frame creel support 32 and is moved into proper position before a cooperating set screw 33 is tightened. A support rod 34 is mounted to the clamp 31 by suitable means and serves to support the elongate strand guide means 35. The rod 34 passes through a mounting block 36 with a cooperating set screw 37 as well as the elongate strand guide means 35 and cooperating set screw 38, permitting both vertical and horizontal adjustment of the apparatus relative to the spinning machine. This arrangement enables the strand interruption apparatus to be properly interposed between the supply package and the drafting system in complete independence of the geometry of the particular machine being fitted.

The elongate strand guide 35 may be fabricated from metal bar stock or tubing or from other suitable materials, such as plastic. In the illustrated embodiment, the elongate strand guide 35 comprises an elongate, cylindrical solid metal rod of a length sufficient to extend past a plurality of successive drafting units. Each elongate strand guide 35 may support a plurality of strand interruption apparatus. The reader will note the versatility of this design in that the spacing of the strand interrupting apparatus on the elongate strand guide may be varied in accordance with the distance between drafting units. Those versed in the art will know that distance between drafting units may vary among the many spinning frame manufacturers.

The strand interruption apparatus which is the subject of the present patent application is illustrated in detail in FIGS. 4 through 9. The reader is referred to my copending patent application Ser. No. 587,396 for additional embodiments that operate on related principles.

As previously stated, a single elongate strand guide 35 may support a plurality of the strand interruption apparatuses on its outer, or strand engaging surface, and may extend past a plurality of successive drafting units.

Near each respective drafting unit, an abutment member 50 is carried by the elongate strand guide and is correspondingly positioned for cooperating with the respective supply strand S. The abutment member 50 may take the form of a sleeve, mounted in surrounding relation on the elongate strand guide 35. This sleeve is essentially cylindrical and has side walls extending generally perpendicular to the longitudinal axis of the elongate strand guide. Included in sleeve 50 is a strand engaging surface 51 which in the illustrated preferred embodiment takes the form of a longitudinally offset projection or anvil, extending along a portion of the inner vertical wall of the Sleeve. Each sleeve also includes means for fixing its position on the elongate strand guide. This means takes the form of a hole extending from the curved outer surface of the sleeve, radially inwardly toward the underlying surface of the elongate strand guide and a cooperating set screw 52. The sleeve is surroundingly placed on the elongate strand guide and moved into a position immediately adjacent the supply strand S; then the set screw 52 is engaged to fix the sleeve's position on the elongate strand guide.

The strand interruption apparatus further comprises a rotatably mounted collar means 60 which is carried by the elongate strand guide and is correspondingly positioned for cooperating with the previously described abutment member 50. The collar means takes the form of a cylndrical collar which is surroundingly positioned on the strand guide and is free to rotate about the axis of the strand guide and to move along its longitudinal axis. The end of the cylindrical collar located closest to the abutment member 50 defines a strand engaging surface 61 extending generally perpendicular to the axis of the elongate strand guide. The collar means is positioned adjacent the abutment member 50, at a distance sufficiently remote to allow the supply strand S to pass freely between the strand engaging surface 51 located on the abutment member 50 and the strand engaging surface 61 on the collar means.

The collar means 60 also includes a target 62, flag 63, and an offset projection 64. The target 62 is mounted longitudinally across the collar and extends vertically upward therefrom. Mounted at the end of the target farthest from the collar is a weight 65 which assists the collar in rotating to effect strand interruption. The flag 63 or other type of indicator means is attached to the underside of the collar means diametrically opposite the target 62. The flag serves to indicate, by moving into a more easily visible position during strand interruption, which drafting station is in an ends down state. A "V" shaped projection 64 extends outwardly from the end of the collar means located opposite the strand engaging surface 61.

A pair of cooperating cam surfaces 66, 71 extending helically of the axis of the elongate strand guide 35 is also provided. One of the cam surfaces 71 is provided on a second tubular sleeve 70, and the other of the cam surfaces 66 is provided at the end wall of the collar means 60 located opposite the strand engaging surface 61 of the collar means. Taken together, the cam surfaces 66, 71 serve to define means cooperating with the actuator means for moving the collar means 60 along the longitudinal axis of the elongate strand guide 35.

The second tubular sleeve 70 further comprises a "V" shaped notch 72 in the cam surface thereof which is sized to receive cooperating "V" shaped projection 64 provided on collar 60 during strand feeding and to provide support to the collar means 60 while in the strand feeding position. The angular arrangement of the cooperating projection 64 and notch also serve to prevent the collar 60 from moving laterally due to vibration during operation of the spinning frame, and thereby avoids unintentional contact with the strands on the collar 60.

Figure 4:
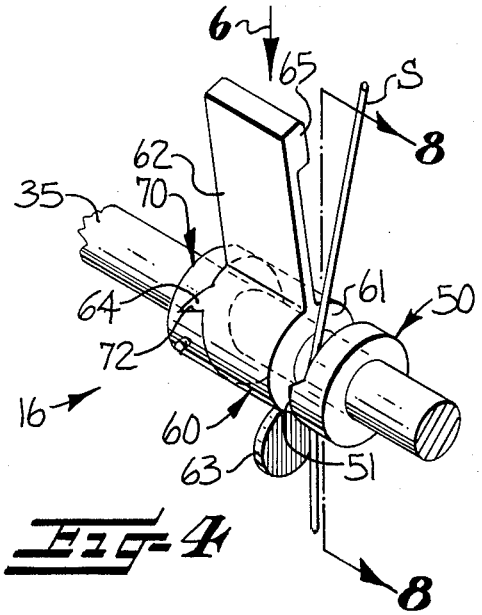
FIG. 4 is a perspective view of a strand interrupting apparatus in accordance with the invention illustrating the strand feeding position.
Figure 6:
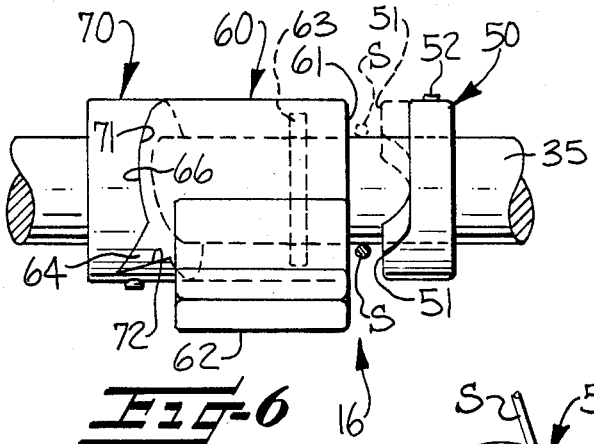
FIG. 6 is a top view of a strand interrupting apparatus in accordance with the invention illustrating the strand feeding position.
Figure 8:
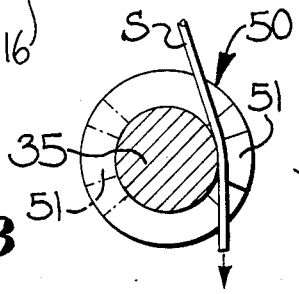
FIG. 8 is an end elevational view taken along line 8—8 of FIGS. 4 and 5, of a strand interrupting apparatus in accordance with the invention depicting the strand feeding and strand interrupting positions.

During normal spinning machine operation, supply strand S travels freely between the strand engaging surfaces of the apparatus, namely, between the inside of projection 51 on abutment member 50 and the oppositely located surface 61 of collar 60. The attenuated strand emerges from the drafting zone in the form of yarn Y and is wound upon a spindle. This operational state, known as "strand feeding" is shown in FIGS. 4, 6, and by the solid lines in FIG. 8. During strand feeding, the strand engaging surfaces 51, 61 are spaced apart and the supply strand S is permitted to run freely therebetween by passing over elongate strand guide 35.

Figure 5:
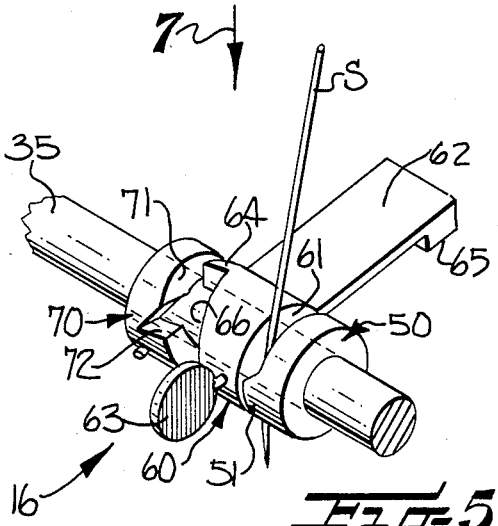
FIG. 5 is a perspective view of a strand interrupting apparatus in accordance with the invention illustrating the strand interrupting position.
Figure 7:
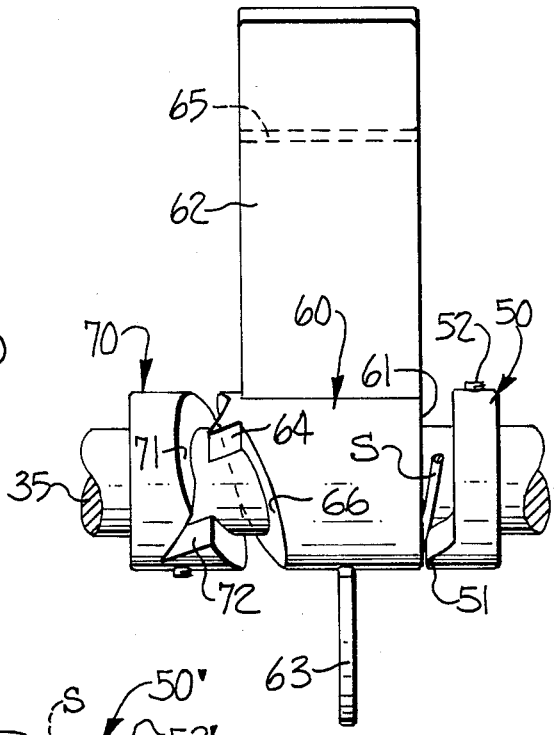
FIG. 7 is a top plan view of a strand interrupting apparatus in accordance with the invention illustrating the strand interrupting position.

When the yarn breaks, interruption of the supply strand must be accomplished. When the traveling detector unit 13 (FIG. 1) senses a broken yarn Y, actuating means in the form of a burst of compressed air indicated at B is directed toward target 62 and the force thereof, in cooperation with the force provided by weight 65 causes the collar means 60 to rotate about the elongate strand guide 35 to the strand engaging position as shown in FIGS. 5 and 7. During strand interruption the rotation of the collar causes the cam surfaces 66, 71 to interact, and because of their helical structure, the collar is forced to slide longitudinally along the elongate strand guide to bring the strand engaging surfaces 51, 61 into proximate relation with one another. As a result, the supply strand S is pinched therebetween and the pull of the rolls 21, 22, 23 causes the supply strand to be parted or broken.

Astute readers will note that in FIGS. 1 and 2 supply strand S passes over the inbound surface (with respect to the frame) of elongate strand guide 35, and that the remaining figures show supply strand S passing outbound of the elognate strand guide. One configuration may easily be changed to the other by simply rotating abutment member 50 which surrounds elongate strand guide 35 by one hundred eighty degrees, as shown by the position indicated by the dotted lines in FIGS. 6 and 8. The decision of whether to run the supply strand S inbound or outbound of a particular strand guide will be dictated by the creel arrangement and position of the roll strand.

A further benefit derived from the above described invention is that flag 63 or other indicator means, upon actuation of the strand interruption apparatus, moves from the position indicated by the solid lines in FIG. 2 to the position indicated by the dotted lines in that same figure. This out of line position (best illustrated in FIG. 3) enables the spinner to easily locate which drafting system is in an "ends down" state and is in need of "piece-up".

Figure 9:
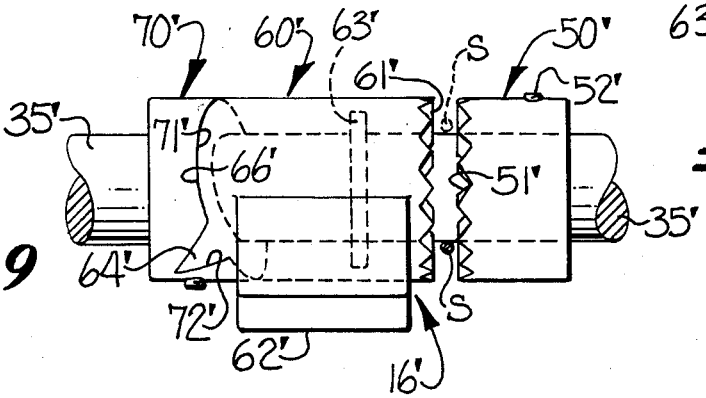
FIG. 9 is a top plan view of a strand interrupting apparatus in accordance with a second embodiment of the invention.

The embodiment illustrated in FIG. 9 is similar in many respects to that previously illustrated and described in detail. To avoid repetition, elements of this embodiment which correspond to those previously described will be identified by corresponding reference numbers, with a prime notation (') added. Basically, this embodiment differs over the previous embodiment in that the cooperating strand engaging surfaces 51' and 61' are toothed or serrated so as to more securely engage and hold the strand S upon actuation and movement of collar 60' axially into the strand engaging position. This is especially suitable for rovings made of very long staple fibers.

In summary, this invention is an apparatus to facilitate supply strand interruption to be used in conjunction with a spinning frame fitted with a traveling unit which senses broken supply strands and supplies actuator means to the strand interruption apparatus to accomplish supply strand interruption. The previously described embodiment and those additional embodiments disclosed in my copending application all operate on the basic principle that during normal operating conditions, the supply strand is permitted to pass freely between strand engaging surfaces, and when strand interruption is required, the collar rotates (in response to an appropriate actuating signal) to move the strand engaging surfaces into proximate relation to cause pinching of the supply strand and to thereby restrict its travel between the strand engaging surfaces, causing supply strand interruption.

In the drawings and specification there has been set forth a preferred embodiment of the invention, and although specific terms have been employed, they are used in a generic sense only and not for purposes of limitation.

That which is claimed is:

1. In the combination of a textile yarn spinning machine having a plurality of drafting units arranged in a series longitudinally of the spinning machine, a plurality of supply strand packages each normally delivering a corresponding supply strand to a corresponding drafting unit for producing a corresponding attenuated strand, means movable along the spinning machine and having detector means for monitoring production of attenuated strands and actuator means for responding to breakage of an attenuated strand, and strand interrupting means mounted on the spinning machine and selectively remotely actuable by the actuator means for interrupting feeding of the corresponding supply strand, an improvement of the strand interrupting means comprising:

means defining an elongate strand guide located between said supply strand packages and said drafting units and extending longitudinally past a plurality of successive drafting units;

respective abutment members carried by said elongate strand guide and being correspondingly positioned for cooperating with the respective supply strands, said abutment members each having a strand engaging surface extending generally perpendicular to the longitudinal axis of said elongate strand guide;

respective longitudinally spaced apart rotatably mounted collar means carried by said elongate strand guide and correspondingly positioned for cooperating with said abutment members, each of said collar means including a strand engaging surface extending generally perpendicular to the longitudinal axis of said elongate strand guide for cooperating with the strand engaging surface of said abutment member;

said collar means being normally oriented in a strand feeding position with the strand engaging surface of said collar means positioned in a spaced apart relation from the cooperating strand engaging surface of said abutment member, whereby the strand is permitted to pass freely therebetween, and said collar means being movable longitudinally of said elongate strand guide to a strand interrupting position in which the cooperating strand engaging surfaces are positioned in a proximate relation to each other for interrupting feeding of the supply strand passing therebetween; and means associated with said collar means and cooperating with said actuator means for effecting longitudinal movement of said collar means from said strand feeding position to said strand interrupting position in response to actuation by said actuator means.

2. Apparatus according to claim 1 wherein said means defining said elongate strand guide comprises an elongate bar extending longitudinally of the spinning machine, and adjustable mounting means for mounting said elongate bar to the spinning machine to permit adjustment of the position of the bar both vertically and horizontally relative to said drafting unit.

3. Apparatus according to claim 1 wherein said means for effecting longitudinal movement of said collar means includes a second abutment member carried by said elongate strand guide and located adjacent said collar means on the side thereof opposite said abutment member and said strand engaging surface, and a pair of cooperating cam surfaces extending helically of the axis of said elongate strand guide, one of said cam surfaces being defined by said second abutment member, and the other of said cam surfaces comprising the side of said collar means opposite said collar strand engaging surface, and wherein said cam surfaces cooperate such that upon actuation by said actuator means, said collar rotates from said strand feeding position to said strand interrupting position and the helical cam surfaces cause said collar to move longitudinaly along said elongate strand guide, thereby moving said strand engaging surfaces into proximate relation with one another for causing the supply strand to be pinched therebetween and resulting in supply strand interruption.

4. Apparatus according to claim 1 wherein said cooperating strand engaging surfaces are toothed.

5. In the combination of a textile yarn spinning machine having a plurality of drafting units arranged in a series longitudinally of the spinning machine, a plurality of supply strand packages each normally delivering a corresponding supply strand to a corresponding drafting unit for producing a corresponding attenuated strand, means movable along the spinning machine and having detector means for monitoring production of attenuated strands and actuator means for responding to breakage of an attenuated strand, and strand interrupting means mounted on the spinning machine and selectively remotely actuable by the actuator means for interrupting feeding of the corresponding supply strand, an improvement of the strand interrupting means comprising:

means defining an elongate bar located between said supply strand packages and said drafting units and extending longitudinally past a plurality of successive drafting units;

respective sleeves carried by said elongate bar and being correspondingly positioned for cooperating with the respective supply strands, said sleeves each having a strand engaging surface extending generally perpendicular to the longitudinal axis of said elongate bar, and including means for adjustably positioning the sleeve along said elongate bar at a desired position with respect to the respective supply strands;

respective longitudinally spaced apart rotatably mounted collar means carried by said elongate bar and correspondingly positioned for cooperating with said sleeves, each of said collar means including a strand engaging surface extending generally perpendicular to the longitudinal axis of said elongate bar for cooperating with the strand engaging surface of said sleeve;

said collar means being normally oriented in a strand feeding position with the strand engaging surface of said collar positioned in a spaced apart relation from the cooperating strand engaging surface of said sleeve, whereby the strand is permitted to pass freely therebetween, and said collar means being movable along the longitudinal axis of said elongate bar to a strand interrupting position in which the strand engaging surface thereof is positioned in a proximate relation to the cooperating strand engaging surface of said sleeve for interrupting feeding of the supply strand passing therebetween; and said collar means further including a target affixed to said collar means and cooperating with said actuator means for effecting rotation of said collar means; and means for effecting movement of said collar means longitudinally along said elongate bar simultaneously with the rotation of said collar means thereabout to thereby move the strand engaging surfaces into proximate relation with one another for causing the supply strand to be pinched therebetween and resulting in supply strand interruption.

6. In the combination of a textile yarn spinning machine having a plurality of drafting units arranged in a series longitudinally of the spinning machine, a plurality of supply strand packages each normally delivering a corresponding supply strand to a corresponding drafting unit for producing a corresponding attenuated strand, means movable along the spinning machine and having detector means for monitoring production of attenuated strands and actuator means for responding to breakage of an attenuated strand, and strand interrupting means mounted on the spinning machine and selectively remotely actuable by the actuator means for interrupting feeding of the corresponding supply strand, an improvement of the strand interrupting means comprising:

means defining an elongate bar located between said supply strand packages and said drafting units and extending longitudinally past a plurality of successive drafting units;

respective tubular sleeves mounted in surrounding relation to said elongate bar and being correspondingly positioned for cooperating with the respective supply strands, said tubular sleeves each having a strand engaging surface extending generally perpendicular to the longitudinal axis of said elongate bar, said tubular sleeves each further including at least one set screw for positioning said sleeve on said elongate bar with respect to the respective supply strands;

repective longitudinally spaced apart rotatably mounted collar means carried by said elongate bar and correspondingly positioned for cooperation with said tubular sleeves, each of said collar means including a strand engaging surface extending generally perpendicular to the axis of said elongate bar for cooperating with the strand engaging surface of said tubular collar;

said collar means being normally oriented in a strand feeding position with the strand engaging surface of said collar means positioned in a spaced apart relation from the cooperating strand engaging surface of said tubular sleeve, whereby the strand is permitted to pass freely therebetween;

said collar means being movable along the longitudinal axis of said elongate bar to a strand interrupting position in which the strand engaging surface thereof is positioned in proximate relation to the cooperating strand engaging surface of said sleeve for interrupting feeding of the supply strand passing therebetween; and means for effecting axial movement of said collar means along the longitudinal axis of said elongate bar, including a second tubular sleeve positioned to surround said elongate bar and located adjacent said collar means on the end thereof opposite said first tubular sleeve, and a pair of cooperating cam surfaces extending helically of the axis of said elongate bar, one of said cam surfaces being defined by said second tubular sleeve, and the other of said cam surfaces comprising the side of said collar means located opposite said strand engaging surface of said collar means; said cam surfaces cooperating such that upon actuation by said actuator means, said collar means rotates from said strand feeding position to said strand interrupting position and the rotation of said collar means causes said helical cam surfaces to move said collar means axially along said elongate bar, thereby moving said strand engaging surfaces into proximate relation with one another, causing the supply strand to be pinched therebetween and resulting in supply strand interruption.

* * * * *